United States Patent [19]

Han et al.

[11] Patent Number: 4,958,470

[45] Date of Patent: Sep. 25, 1990

[54] ELEVATED POST ANCHOR

[75] Inventors: Chris M. Han, Fremont; Vernal V. Long; Douglas T. Silver, both of Danville, all of Calif.

[73] Assignee: Silver Metal Products, Inc., Calif.

[21] Appl. No.: 301,416

[22] Filed: Jan. 24, 1989

[51] Int. Cl.[5] ..... E02D 27/00

[52] U.S. Cl. ..... 52/296; 52/370; 52/704

[58] Field of Search ..... 52/295, 296, 297, 370, 52/712–715, 704–707, 250; 248/247, 248, 300

[56] References Cited

U.S. PATENT DOCUMENTS

| | | | |
|---|---|---|---|
| 1,592,681 | 7/1926 | Grothe | 52/370 X |
| 2,227,713 | 1/1941 | Higgins | 52/704 X |
| 2,753,962 | 7/1956 | McBerty | 52/250 X |
| 3,065,661 | 11/1962 | Kolec et al. . | |
| 3,192,821 | 7/1965 | Siebol . | |
| 3,413,773 | 12/1968 | Fitzgerald | 52/295 X |
| 3,515,028 | 6/1970 | Patton . | |
| 3,911,782 | 10/1975 | Liebig . | |
| 3,921,356 | 11/1975 | Hughes | 52/370 X. |
| 4,096,677 | 6/1978 | Gilb | 52/297 |
| 4,387,543 | 6/1983 | Tschan et al. | 52/295 |
| 4,568,215 | 2/1986 | Nelson . | |
| 4,614,070 | 9/1986 | Idland | 52/296 |
| 4,705,423 | 11/1987 | Smith . | |

OTHER PUBLICATIONS

Silver Metal Products, Inc. (1984) Catalog pages illustrating CP Post Anchor.

*Primary Examiner*—Richard E. Chilcot, Jr.
*Attorney, Agent, or Firm*—Robert R. Tipton

[57] ABSTRACT

A structural support is adapted to elevate the base of a structural member, such as, a wooden post, above a concrete surface where is would be subject to water related wood damage. A supporting shaft is connected at its upper end, to a generally U-shaped bracket member and is imbedded in concrete proximate its lower end. The lower end of the shaft is deformed or embossed to increase the resisting power in the vertical direction to the concrete. Indicia is provided along the supporting shaft to indicate maximum clearance elevation for the embedded shaft.

4 Claims, 6 Drawing Sheets

200
212
214
218
220
222
222A
222B
223
224
225
240
242A
242B
242C
242D
244
248
250A
250B
250C
250D
252A
252B
252C
254A
254B
254C
254D
256

ELEVATED POST ANCHOR

BACKGROUND OF THE PRIOR ART

This invention relates generally to construction anchors and in particular to constructions anchors for supporting structural members that are anchored to and elevated above a concrete surface.

The present invention is particularly adapted for use in supporting vertical structural members for carports, trellises, privacy screens and fence posts where the base of the post or structural support will often be exposed to water or other liquids likely to cause the wood to decay or become destroyed.

The devices of the prior art usually comprised pairs of metal straps embedded in the concrete and attached to opposite sides of the post or structural support.

Sometimes a U-shaped bracket would be used wherein the bottom of the "U" portion would be embedded in the concrete permitting the two legs of the "U" to protrude upwardly so that a post could be mounted between the two legs of the "U".

Both of these types of anchors posed problems when embedded in the concrete in that considerable repair of the wet concrete was required after they were inserted.

Both of these types of anchors also posed a further problem in that debris generally accumulated between the vertical straps and was difficult to remove.

SUMMARY OF THE INVENTION

The elevated post anchor of the present invention overcomes these problems by utilizing a generally U-shaped bracket member that is adapted to be connected to a structural support. A support shaft member is connected proximate its upper end to the base of the U-shaped bracket member with its lower end adapted to be embedded in a concrete base. The lower end of the shaft is provided with a means for increasing the holding power of the anchor in the concrete base and thus the resistance of the shaft to vertical movement due to the vertical forces resulting from by the weight of the structural member being supported.

The supporting shaft is also fabricated from a flat sheet of metal rolled into a cylindrical or rectangular shape.

Means are provided proximate the upper end of the shaft and in the base of the U-shaped bracket member for either separately or integrally connecting the shaft to the U-shaped bracket member.

Means are also provided in the form of indicia on the shaft of the anchor to establish the maximum clearance height when embedding the device in a concrete base.

It is, therefore, an object of the present invention to provide an anchor for a structural member that is elevated above the surface of the concrete base.

It is a further object of the present invention to provide an anchor for a structural member that is simple to accurately install in a concrete base and requires a minimum of repair to concrete surface.

It is yet another object of the present invention to provide anchor support for a structural member that possesses an increased resistance to vertical movement in the concrete base support caused by the weight of the structural member being supported.

It is another object of the present invention to provide an anchor support for elevating a structural member above a concrete base in which the bracket supporting the structural member is attached to the supporting shaft by swaged tabs or orbital riveting.

It is still another object of the present invention to provide an anchor support for a structural member in which the maximum vertical supporting force is determined by the either the structural member being supported or the supporting shaft of the anchor of the present invention.

These and other objects of the present invention will become manifest upon study of the following specification when taken together with the drawings.

DESCRIPTION OF THE PREFERRED EMBODIMENT

Figure 3:
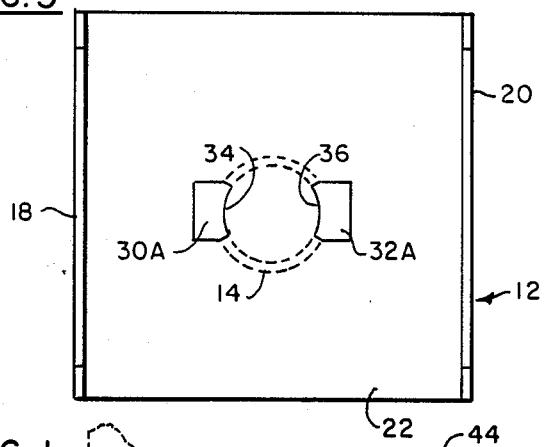
FIG. 3 is a top view of the elevated anchor support of FIGS. 1 and 2.
Figure 1:
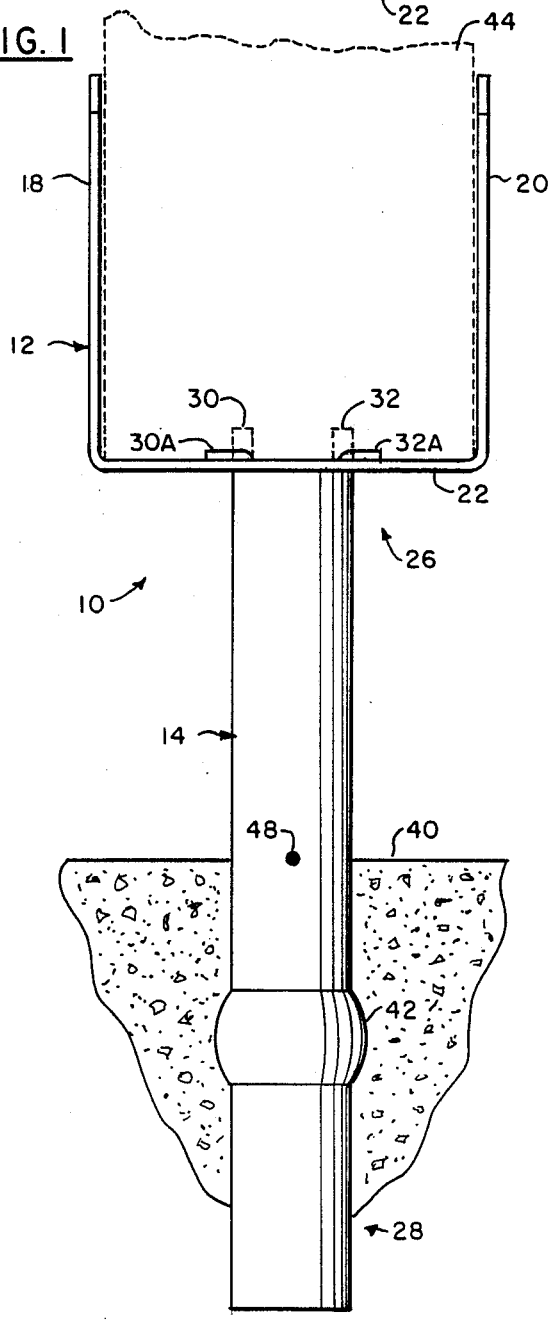
FIG. 1 is a front elevational view of the elevated anchor support of the present invention.
Figure 2:
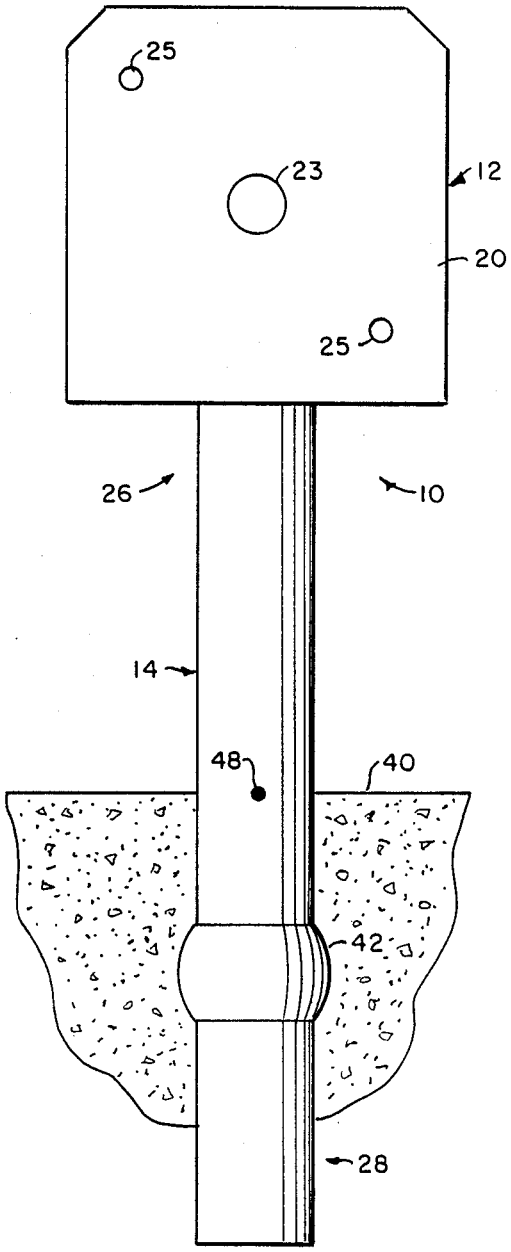
FIG. 2 is a side elevational view of the elevated anchor support of FIG. 1.

With reference to FIGS. 1, 2 and 3, there is illustrated front, side and top views, respectively, of the elevated support anchor 10 of the present invention comprising, basically, a generally U-shaped bracket member 12 connected proximate the top of a supporting shaft member 14.

Generally U-shaped bracket member 12 comprises a pair of generally parallel leg members 18 and 20 integrally connected to horizontally disposed base-plate member 22.

Leg members 18 and 20, typically comprise a hole 23 adapted to receive a bolt or lag screw (not shown) and a pair of nail holes 25, as shown in side elevation FIG. 2. Leg member 18 typically comprises (see FIG. 4) a hole 21 adapted to receive a bolt or lag screw and a pair of nail holes 24 (see FIG. 4).

Supporting shaft member 14 comprise an upper end or portion 26 and a lower end or portion 28.

Support shaft 14, at it upper end 26, further comprises a pair of tabs 30 and 32 adapted to be received by openings 34 and 36, respectively (see FIG. 3), in base-plate member 22 and be deformed to lay against the top surface thereof. The undeformed position of tabs 30 and 32 are indicated by the tabs 30A and 32A, respectively, shown in dashed lines.

Figure 3A:
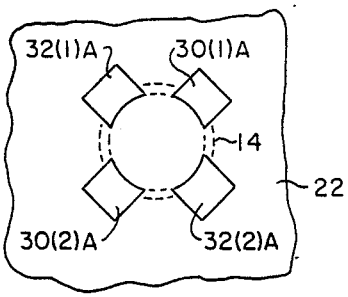
FIG. 3A is a top view of the elevated anchor support of FIGS. 1 and 2 illustrating a further embodiment of a method of connecting the U-shaped bracket member to the supporting shaft.

With reference to FIG. 3A a further embodiment of a method of attaching U-shaped bracket member 12 to supporting shaft member 14 utilizes four tabs 30(1)A, 30(2)A, 32(1)A and 32(2)A.

Support shaft 14, at it lower end 28, is adapted to be embedded in concrete base support 40. Support shaft 14 further comprises a protrusion 42, or the like, embossed or deformed therein for the purpose of increasing the resistance of shaft 14 to vertical movement in concrete base support 40 caused by the weight of the structural member 44 mounted in U-shaped bracket member 12.

Indicium 48 is provided along shaft 14 to establish the maximum clearance of U-shaped bracket member 12 above the surface of concrete base support 40.

Figure 4:
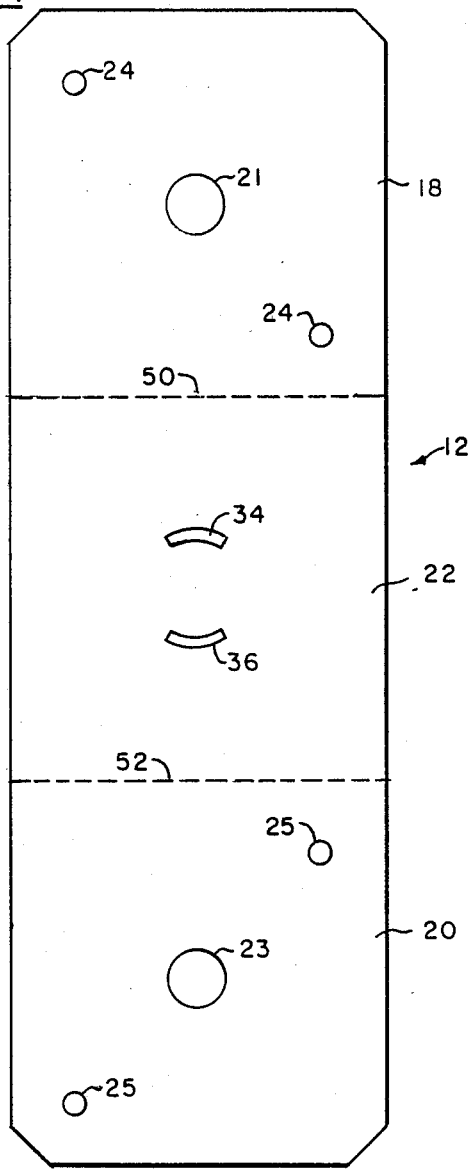
FIG. 4 is a drawing of the U-shaped bracket member of FIGS. 1, 2 and 3 as it would appear when fabricated out of a blank sheet of metal.

With reference to FIG. 4, there is illustrated a plan view of the sheet metal blank from which U-shaped bracket member 12 is fabricated. The solid lines represent shear lines while the dashed lines represent bend lines.

The sheet metal strip is first sheared to create a generally rectangular blank with openings 34 and 36 that are adapted to receive tabs 30 and 32 of support shaft 14. Bolt or lag screw holes 21 and 23, as well as nail holes 24 and 25 are also punched at the same time.

The two side legs 18 and 20 are formed by bending, respectively, along bend lines 50 and 52 until legs 18 and 20 are generally parallel to each other and perpendicular to base-plate 22.

Figure 5:
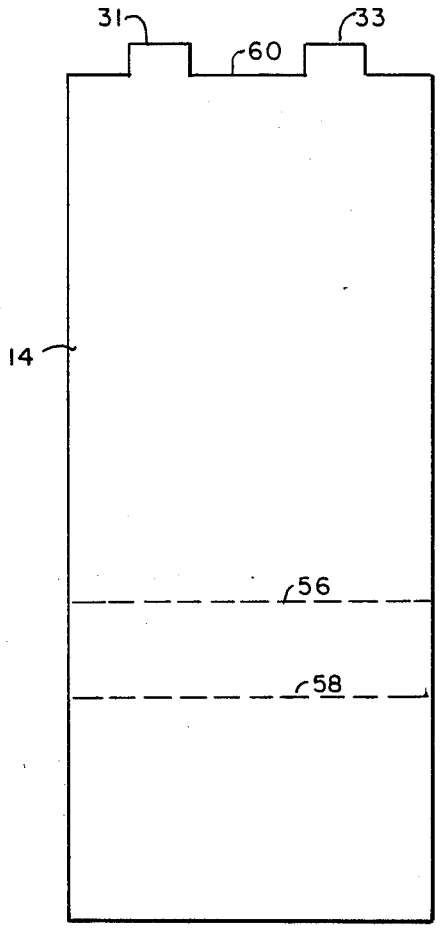
FIG. 5 is a drawing of the supporting shaft member of FIGS. 1, 2 and 3 as it would appear when fabricated out of a blank sheet of metal.

With reference to FIG. 5, there is illustrated a plan view of sheet metal blank from which support member 14 is fabricated. The solid lines represent shear lines while the dashed lines represent bend lines.

The support member 14 is first sheared out of a sheet metal blank to define a generally rectangular shape with undeformed tabs 30A and 32A projecting proximate one end.

The blank is then deformed or embossed between bend lines 56 and 58 to define a generally cylindrical protrusion extending across the flat sheet.

The blank is then rolled into a cylinder with undeformed tabs 30A and 32A at one end and with the generally cylindrical protrusion defining a protruding ring about the outer surface of shaft 14 proximate the other end.

The diameter of shaft 14 is predetermined so that undeformed tabs 30 and 32 will be received by openings 34 and 36 in generally U-shaped bracket member 12.

It can be seen that top edge 60 of shaft 14 (FIG. 5) between tabs 30 and 32 will act as a stop as well as a bearing surface for base-plate 22 on U-shaped bracket 12.

When tabs 30A and 32A are swaged down to define swaged tabs 30 and 32, respectively, against the top surface of base-plate 22, shaft 14 will be rigidly attached to U-shaped bracket member 12.

With reference to FIGS. 6 through 10, inclusive, there is illustrated a further method of attaching U-shaped bracket member 12 to supporting shaft 14.

Figure 6:
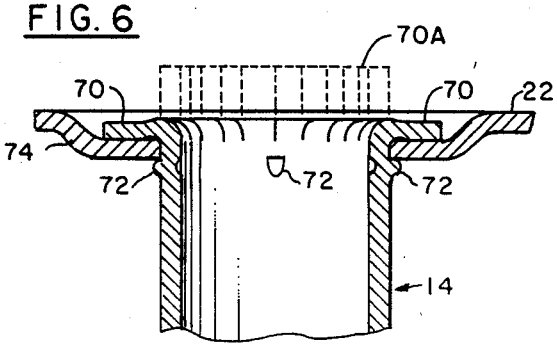
FIG. 6 is an elevational, cross-sectional view of a further method of attaching the U-shaped bracket member to the support shaft member.

With reference to FIG. 6, upper end of support shaft 14 is shown attached to base-plate member 22 by a plurality of tabs 70 deformed as by swaging or the like onto the top surface of base-plate 22.

Tabs 70 in their undeformed state are shown as tabs 70A in dashed line.

The underside of base-plate 22 is adapted to engage and be supported by a plurality of dimples or stops 72 protruding outwardly from the outside surface of shaft 14. Dimples or stops 72 are created by deforming the wall of shaft 14 radially outwardly.

Thus base-plate member 22 can be firmly and rigidly attached to the top end of support shaft 14.

In order to provide a generally flat bearing surface upon which a structural member can rest, base-plate member 22 is deformed to define a depressed area having sloping sides 74 surrounding tabs 70.

Figure 7:
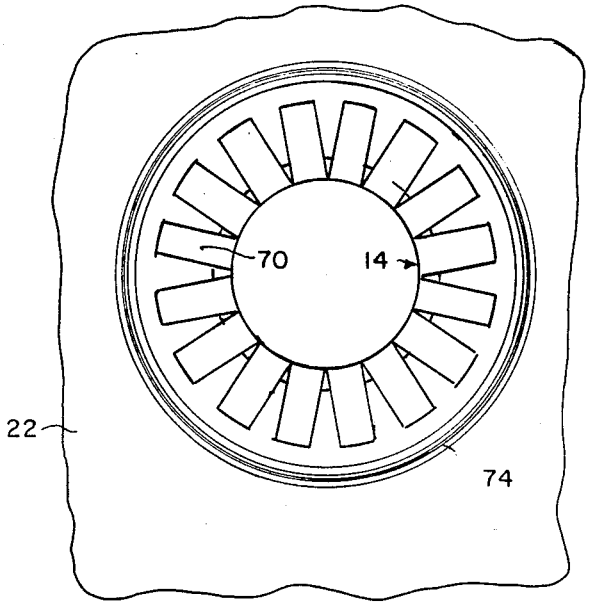
FIG. 7 is a top view of the method of connection shown in FIG. 6.
Figure 8:
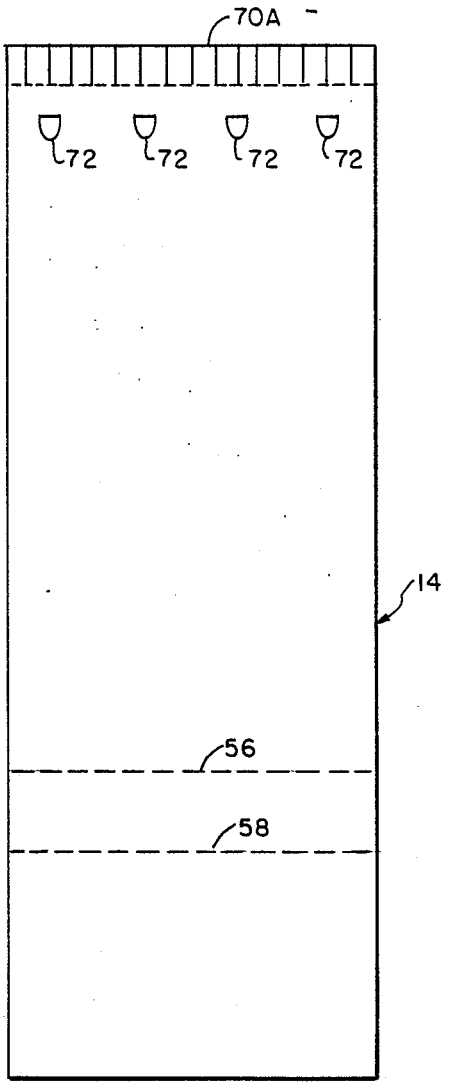
FIG. 8 is a drawing of the supporting shaft member of FIGS. 6 and 7 as it would appear when fabricated out of a blank sheet of metal.

With reference to FIG. 8, there is illustrated a plan view of the sheet metal blank from which support shaft 14 of FIGS. 6, 7 and 8 is fabricated. The solid lines represent shear lines while the dashed lines represent bend lines.

Proximate top end of shaft 14 are a plurality of undeformed tabs 70A. As shown in FIGS. 6 though 9, inclusive, tabs 70 are indicated as immediately adjacent each other. In some instances, it may be desirable to shear out every other tab so that the tabs are spaced a tab-width apart from each other.

Figure 9:
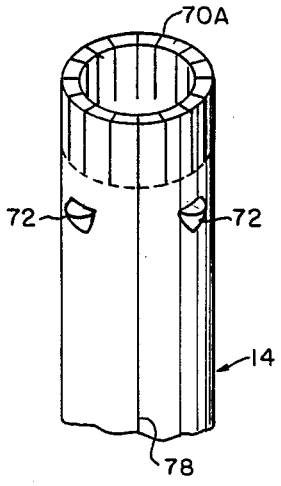
FIG. 9 is an isometric view of the supporting shaft member of FIGS. 6, 7 and 8 prior to being swaged into the U-shaped bracket member.

After the blank for shaft 14 has been sheared and dimples or stops 72 have been created by deforming blank, and protrusion 42 embossed along bend lines 56 and 58 proximate the lower end of shaft 14, the blank is then rolled into a generally cylindrical shape with tabs 70A and stops 72 projecting from one end as shown in FIG. 9.

Seam line 78 of FIG. 9 defines where the two side edges of the sheet metal blank for shaft 14 meet.

Figure 10:
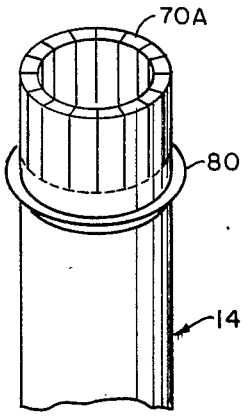
FIG. 10 is an isometric view of a supporting shaft similar to that of FIGS. 8 and 9, however, provided with a swaged peripheral annular ring support for the U-shaped member.

With reference to FIG. 10, there is illustrated a further embodiment of a stop 80 that can be used to support the underside of base-plate member 22 when tabs 70A are swaged against the top surface of base-plate member 22.

Stop 80 is created by upsetting the area of shaft 14 just below tabs 70 to define a peripheral ridge projecting outwardly from the surface of shaft 14. Stop 80 is adapted to support and bear against the underside of base-plate member 22.

With reference to FIGS. 17 through 21, inclusive, there is illustrated a further embodiment of a method of attaching the supporting leg member to the U-shaped supporting bracket holding the supported beam.

Figure 17:
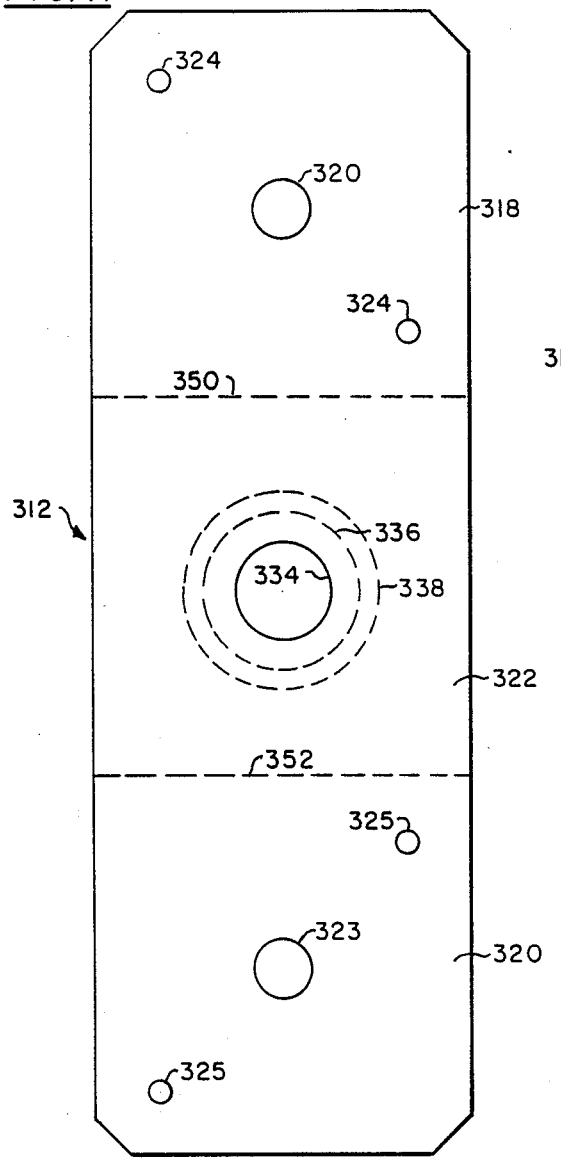
FIG. 17 is a drawing of a further embodiment of the U-shaped bracket member of FIGS. 1, 2 and 3 as it would appear when fabricated out of a blank sheet of metal.

With reference to FIG. 17 there is illustrated the sheet metal blank from which U-shaped bracket 312 is fabricated. The solid lines represent shear lines while the dashed lines represent bend of deformation lines.

Holes 321, 323, 324 and 325 and bend lines 350 and 352 of FIG. 17 are similar to corresponding holes and bend lines of FIG. 4.

Figure 21:
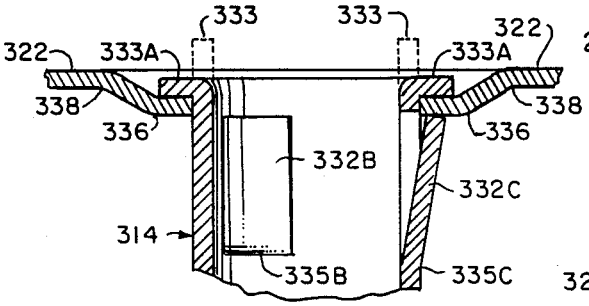
FIG. 21 is an elevational, cross-sectional view of a further method of attaching the U-shaped bracket member to the support shaft member taken at lines 21—21 of FIG. 20.

Hole 334, central to base-plate 322, is surrounded by concentric bend of deformation lines 336 and 338, seen in profile in FIG. 21. As in the case of FIG. 6, the area around hole 334 is depressed to provide an even or flat bearing surface for the bottom end of the supported beam.

When bent along bend lines 350 and 352, leg members 318 and 320 are formed to define a U-shaped bracket member analogous to legs 18 and 20 of FIGS. 1, 2 and 3.

Figure 18:
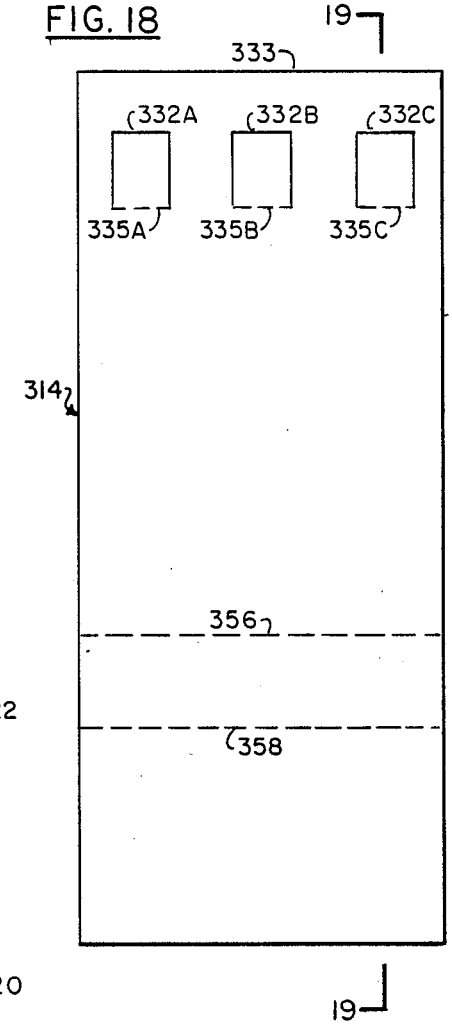
FIG. 18 is a drawing of a further embodiment of the supporting shaft member of FIGS. 1, 2 and 3 utilizing a different method of attachment to the U-shaped bracket of FIG. 17 as it would appear when fabricated out of a blank sheet of metal.

With reference to FIG. 18 there is illustrated a plan view of the sheet metal blank from which support member 314 is fabricated. The solid lines represent shear lines while the dashed lines represent bend or deformation lines.

Figure 19:
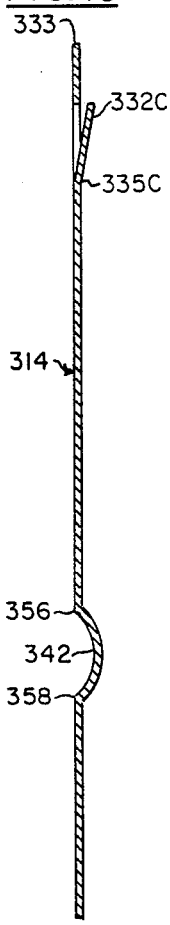
FIG. 19 is a cross-sectional elevational view of the support shaft blank of FIG. 18 taken at lines 19—19.

Support member 314 is first sheared out of a sheet metal blank simultaneously punching out holes 321, 323, 324, 325, and 334 as well as generally rectangular tabs 332A, 332B and 332C just below top edge 333 which are sheared and partially bent outwardly as shown in FIG. 19.

Figure 20:
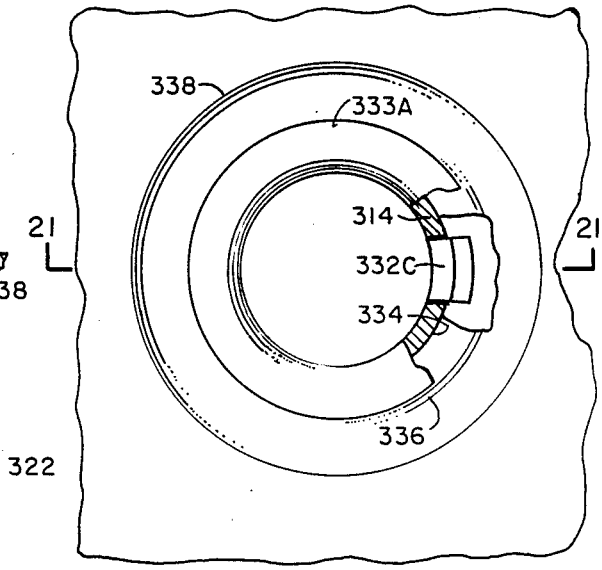
FIG. 20 is a top view of the method of connecting the U-shaped bracket of FIG. 17 to the supporting shaft of FIG. 18.

The strip of metal above tabs 332A, 332B and 332C along top edge 333 will be deformed, as shown in FIGS. 20 and 21, around the top inner edge of hole 334.

Bend or deformation lines 356 and 358 define the boundary for protrusion 342 that is used to increase the the holding power of supporting member 314 in its concrete base (see FIGS. 1 and 2).

The blank form for supporting member 314 is then rolled to define a cylinder in which tabs 332A, 332B and 332C project outwardly about the periphery of the cylinder proximate top edge 333. Top edge 333 is then inserted into hole 334, as shown in FIG. 21 (the top edge of supporting member 314 is showed dotted in FIG. 21), until the top edge of tabs 332A, 332B and 332C have contacted and bear against the underside of base-plate 322.

The strip of metal immediately below top edge 333 is then swaged or riveted with an orbital riveting machine down against the top surface of base-plate 322 to define lip 333A, this forming a rigid connection of base support member 314 to base-plate 322.

Figure 12:
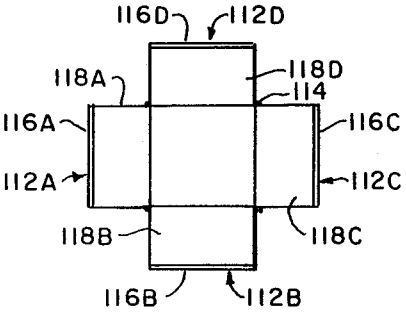
FIG. 12 is a top view of the elevated anchor support of FIG. 11.
Figure 11:
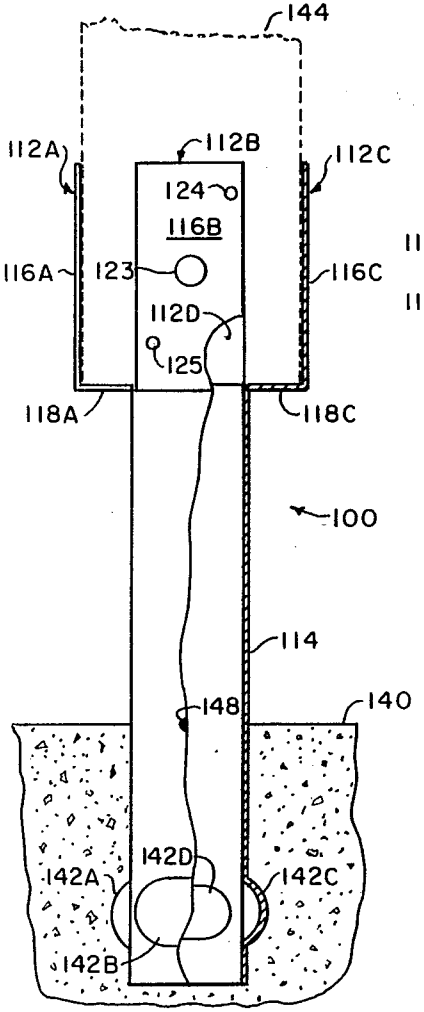
FIG. 11 is an elevational view of a further embodiment of the elevated anchor support of the present invention.

With reference to FIGS. 11 and 12, there is illustrated an elevated support anchor 100 of the present invention, being a further embodiment of the elevated support anchor 10 illustrated in FIGS. 1 and 2.

Elevated anchor support 100 comprises, basically, a set of split "U" or L-shaped supporting brackets 112A, 112B, 112C and 112D integrally connected to a generally rectangular supporting shaft 114.

Split "U" or L-shaped supporting brackets 112A, 112B, 112C and 112D each comprise a generally vertical side support leg 116A, 116B, 116C and 116D integrally connected, respectively, to a generally horizontal base support legs 118A, 118B, 118C and 118D. The end of each leg 118A through 118D is integrally connected to the top edge of a respective side of generally rectangular support shaft 114.

A hole 123, adapted to receive a bolt or lag screw, and a pair of nail holes 124 and 125 are provided in vertical side support leg 116D. A pair of nail holes 126 and 127 are provided in vertical side support legs 116A and 116C.

Support shaft 114, proximate its lower end, is adapted to be embedded in concrete base 140. Support shaft 114 further comprises a set of protrusions, or the like, 142A, 142B, 142C and 142D on each of the faces of shaft 114, embossed therein for the purpose of increasing the holding power of shaft 114 and prevent it from moving vertically in concrete base 140 due to the weight of structural member 144 mounted between supporting legs 116A, 116B, 116C and 116D.

Indicia 148 are provided along shaft 114 to establish the maximum clearance of bracket members 112A, 112B, 112C and 112D above the surface of concrete base support 140.

Figure 13:
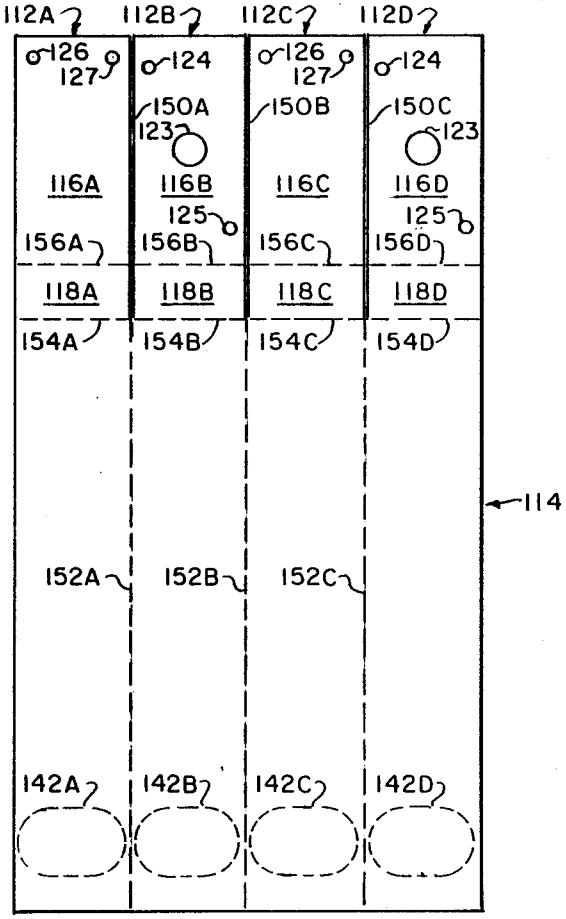
FIG. 13 is a drawing of the elevated anchor support embodiment of FIGS. 11 and 12 as it would appear when fabricated out of a blank sheet of metal.

With reference to FIG. 13, there is illustrated a plan view of the sheet metal blank from which elevated support anchor 100 is fabricated. The solid lines represent shear lines while the dashed lines represent bend lines.

The blank is first sheared to along shear lines 150A, 150B, and 150C to define supporting brackets 112A, 112B, 112C and 112D. Simultaneously, protrusions 142A, 142B, 142C and 142D are embossed in the lower portion of shaft 114.

Also simultaneously, holes 123, 124, 125, 126 and 127 are punched out of the blank.

The blank is then bent along bend lines 154A, 154B, 154C and 154D to form base support members 118A, 118B, 118C and 118D, respectively, at right angles to support leg 114, respectively. Side support members 116A, 116B, 116C and 116D are then bent along bend lines 156A, 156B, 156C and 156D to form a right angle with base support members 118A, 118B, 118C and 118D, respectively.

Supporting member 114 is then formed by bending along bend lines 152A, 152B and 152C to define a generally rectangular shaft.

Figures 14, 15, 16:
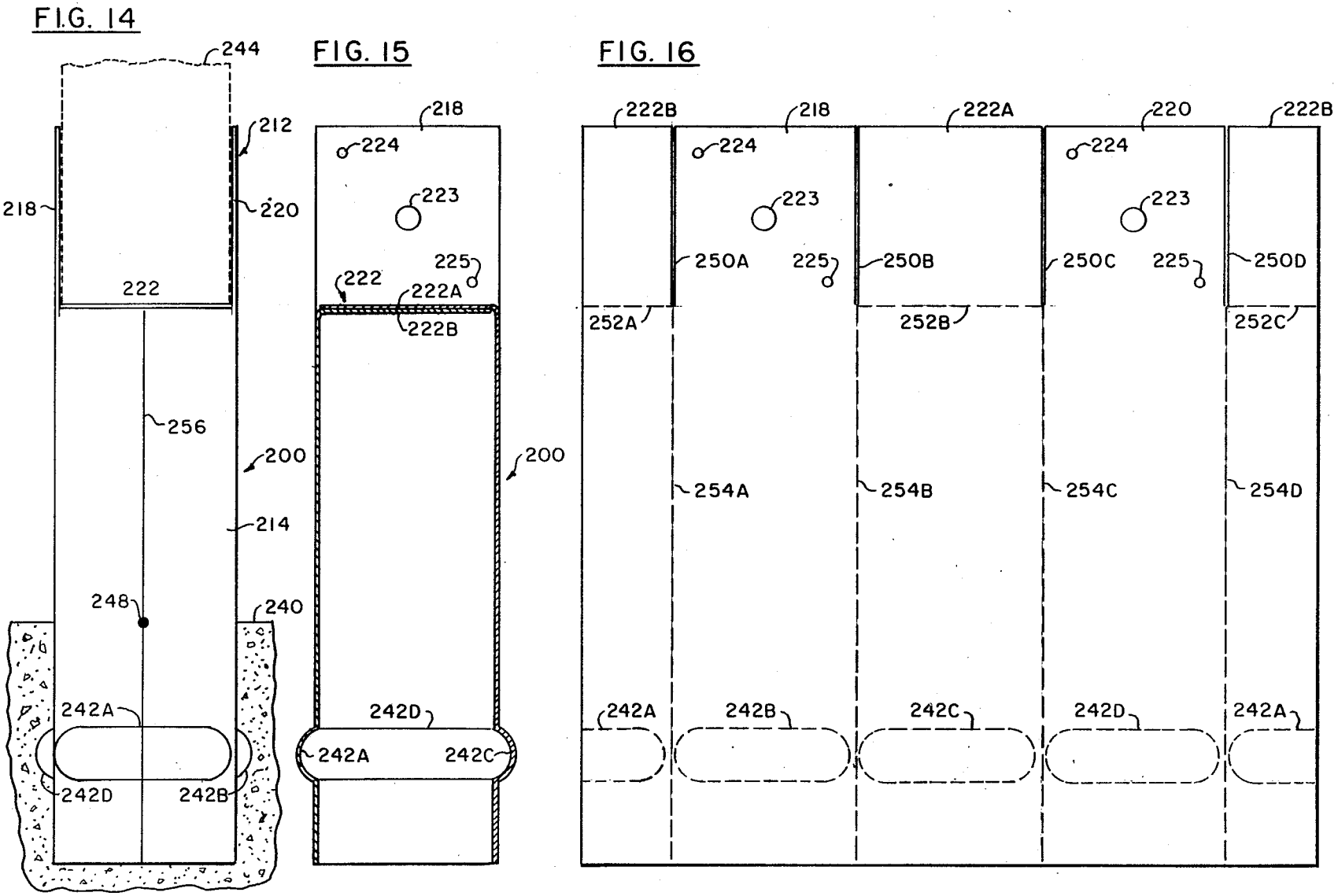
FIG. 14 is a front elevational view of another embodiment of of the elevated anchor support of the present invention.
FIG. 15 is a side elevational view of the elevated anchor support of FIG. 14.
FIG. 16 is a drawing of the elevated anchor support embodiment of FIGS. 14 and 15 as it would appear when fabricated out of a blank sheet of metal.

With reference for FIGS. 14 and 15, there is illustrated a further embodiment of the elevated support anchor 200 of the present invention comprising, basically, a generally U-shaped post support 212 integrally connected to a supporting shaft 214.

FIG. 14 is a front elevational view of elevated support anchor 200. FIG. 15 is a sectional, side elevation view of elevated support anchor 200 of FIG. 14.

Generally U-shaped post support 212 comprises a pair of generally parallel leg members 218 and 220 integrally connected to opposite sides of generally rectangular support shaft 214 and base-plate 222. Base-plate 222 comprises overlapping base-plate members 222A and 222B (FIG. 15) integrally connected to opposite sides of support shaft 214.

Leg members 218 and 220, typically comprise a bolt or lag screw hole 223 (FIG. 15) and a pair of nail holes 224 and 225.

Generally rectangular support shaft 214, proximate its lower end, is adapted to be embedded in concrete base support 240. Support shaft 214 further comprises a set of protrusions, or the like, 242A, 242B, 242C and 242D embossed or deformed therein for the purpose of increasing the holding power of shaft 214 in concrete base 240 and prevent it from moving vertically in concrete base 240 due to the weight of structural member 44 mounted in U-shaped bracket member 212.

Indicia 248 are provided along shaft 214 to establish the maximum clearance of U-shaped bracket 212 above the surface of concrete base support 240.

With reference to FIG. 16, there is illustrated a plan view of a sheet metal blank from which elevated support anchor 200 of FIG. 14 and 15 can be fabricated. The solid lines represent shear lines while the dashed lines represent bend lines.

The blank is first sheared along shear lines 250A, 250B, 250C and 250D to define, respectively, one half of base-support member 222B, leg member 218, base-support member 222A, leg member 220 and the other half of base support member 222B. Simultaneously, protrusions 242A, 242B, 242C and 242D are embossed in the lower portion of support shaft 214. Also simultaneously, holes 223 224 and 225 are punched out of the blank.

The blank is then bent along bend lines 252A, 252B and 252C at right angles to support shaft 214 to form one half of base-support member 222B, base-support member 222A and the other half of base-support member 222B.

It will be noted that bend lines 252A, and 252C must be offset, by an amount approximately equal to the thickness of the sheet metal, from bend line 252B in order for base-support members 222A and 222B to overlap.

The blank is then bent along bend lines 254A, 254B, 254C and 254D to form generally rectangular support shaft 214.

Seam line 256 (FIG. 14) defines where the two edges of shaft 214 and base support member 222B meet.

Although the preferred embodiment has been described in detail, it can be seen that a person having skill in the art may conceive other embodiments employing comparable elements or that certain elements may be modified, combined or changed but still come within the scope of the following claims.

We claim:

1. An elevated structural support comprising a concrete base, a support member having an upper end and a lower end, said lower end adapted to be embedded in said concrete base, a generally U-shaped bracket member, a structural member adapted to be supported by said U-shaped member, means for connecting said upper end of said support member to said generally U-shaped bracket member, said means comprising means defining a generally circular hole in said generally U-shaped bracket member, said hole having a diameter approximately equal to the outside diameter of said support shaft, at least one generally rectangular tab, integrally connected to said support member proximate its upper end and disposed below the top edge of said support member, said generally rectangular tab projecting radially outwardly, said tab having a top edge adapted to engage the underside of said U-shaped bracket member proximate the peripheral edge of said circular hole, the top edge of said of said support member being deformed radially outwardly along the top surface of said U-shaped bracket member about the peripheral edge of said circular hole, means proximate the lower end of said support member for increasing the resistance of said support member to movement in said concrete base due to the weight of said structural member on said U-shaped bracket member.

2. The elevated structure support as claimed in claim 1 further comprising indicia on said support member to indicate maximum permitted elevation of said U-shaped support bracket above said concrete base surface.

3. The elevated structure support as claimed in claim 1 wherein said support member further comprises a sheet of metal rolled into a cylindrical shaft.

4. An elevated structural support comprising a concrete base, a support member having an upper end and a lower end, said lower end adapted to be embedded in said concrete base, a generally U-shaped bracket member, a structural member adapted to be supported by said U-shaped member, means for connecting said upper end of said support member to said generally U-shaped bracket member, said means comprising means defining a generally circular hole in said generally U-shaped bracket member, said hole having a diameter approximately equal to the outside diameter of said support shaft, means defining a protrusion projecting radially outward from the outer surface of said support member proximate its upper end creating an outside diameter greater than the inside diameter of said generally circular hole in said U-shaped bracket, said outwardly projecting protrusion being disposed below the top edge of said support member, said protrusion having a top edge adapted to engage the underside of said U-shaped bracket member proximate the peripheral edge of said circular hole, and the top edge of said of said support member being deformed radially outwardly along the top surface of said U-shaped bracket member about the peripheral edge of said circular hole.

* * * * *